US007093839B2

(12) United States Patent
Anderson

(10) Patent No.: US 7,093,839 B2
(45) Date of Patent: Aug. 22, 2006

(54) HOCKEY STOP MULTI-LINE ROLLER SKATE AND WHEELS FOR USE THEREWITH

(76) Inventor: Stephen R. Anderson, 901 Charlton Rd., Glenville, NY (US) 12302

( * ) Notice: Subject to any disclaimer, the term of this patent is extended or adjusted under 35 U.S.C. 154(b) by 0 days.

(21) Appl. No.: 10/157,268

(22) Filed: May 28, 2002

(65) Prior Publication Data

US 2003/0222418 A1 Dec. 4, 2003

(51) Int. Cl.
*A63C 17/00* (2006.01)

(52) U.S. Cl. ..... 280/11.222; 280/11.206; 280/11.221; 280/11.223; 301/5.301; 301/5.7

(58) Field of Classification Search ..... 280/841, 280/11.19, 11.206, 11.207, 11.221, 11.222, 280/11.223, 11.231; 301/313, 5.7, 5.1
See application file for complete search history.

(56) References Cited

U.S. PATENT DOCUMENTS 108,184 A * 10/1870 Pollitt ..... 280/11.27
301,676 A 7/1884 Clark
308,744 A 12/1884 Brix
622,391 A * 4/1899 Rankin et al. ..... 301/5.307
954,993 A * 4/1910 Peters ..... 280/11.19
2,064,690 A * 12/1936 Peters ..... 280/11.28
2,166,767 A * 7/1939 Schavone ..... 280/11.226
3,103,387 A * 9/1963 Saxenberg ..... 301/5.7
3,414,280 A * 12/1968 Peterman ..... 280/11.19
3,689,061 A * 9/1972 Nystrand ..... 493/369
3,689,091 A * 9/1972 Nagin et al. ..... 280/11.12
4,208,073 A * 6/1980 Hechinger ..... 301/5.302
4,273,345 A * 6/1981 Ben-Dor et al. ..... 280/11.208
4,294,456 A * 10/1981 Tuell et al. ..... 280/11.28
4,603,868 A * 8/1986 Schutz ..... 280/7.13
4,768,793 A * 9/1988 Spencer ..... 280/842
5,183,276 A * 2/1993 Pratt ..... 280/11.221
5,192,088 A * 3/1993 Yu ..... 280/11.225
5,251,920 A 10/1993 McHale
5,401,037 A * 3/1995 O'Donnell et al. .... 280/11.204
5,527,100 A * 6/1996 O'Donnell et al. ..... 301/5.309
5,549,309 A 8/1996 Gleichmann
5,655,784 A * 8/1997 Lee ..... 280/11.223
5,697,622 A 12/1997 Warinner
5,813,678 A * 9/1998 Robins ..... 280/11.204
5,855,385 A * 1/1999 Hambsch ..... 280/87.042
5,893,569 A * 4/1999 Robins ..... 280/11.204
5,908,196 A * 6/1999 Weiss ..... 280/11.19
5,924,705 A 7/1999 Kubelka
6,019,378 A * 2/2000 Cushing ..... 280/11.209

(Continued)

FOREIGN PATENT DOCUMENTS

GB 2178967 A * 2/1987

*Primary Examiner*—Christopher P. Ellis
*Assistant Examiner*—Kelly E. Campbell
(74) *Attorney, Agent, or Firm*—Jay R. Yablon

(57) ABSTRACT

A wheel with an asymmetrical cross-section for use with a roller skate. The wheel also has a tread portion that can be easily and inexpensively replaced. An apparatus for multi-line roller skates that has two or three lines of wheels. The wheels in the center line have a coefficient of friction that is lower than the coefficients of friction of either of the outer lines of wheels. The wheels in the outer lines have asymmetrical cross-sections, while the wheels in the center line have symmetrical cross-sections. A multi-line roller skate that employs these technologies is disclosed. Also disclosed is a method for improving roller skate performance employing the aforementioned technologies.

43 Claims, 7 Drawing Sheets

U.S. PATENT DOCUMENTS 6,036,289 A 3/2000 Boyer
6,042,123 A 3/2000 Eck, Sr.
6,070,885 A 6/2000 Ferone
6,131,923 A * 10/2000 Miotto ..... 280/11.223
6,237,960 B1 * 5/2001 Dornhofer ..... 280/842
6,322,154 B1 * 11/2001 Alderman et al. ..... 301/5.303
6,578,930 B1 * 6/2003 Alderman et al. ..... 301/5.303

* cited by examiner

HOCKEY STOP MULTI-LINE ROLLER SKATE AND WHEELS FOR USE THEREWITH

FIELD OF INVENTION

The present invention relates generally to a wheel and an apparatus for use with a roller skate, an improved hockey stop multi-line roller skate, and a method of improving the performance of a roller skate.

BACKGROUND of INVENTION

Roller skating, specifically in-line and multi-line skating, has witnessed a boom in popularity in recent years. Aside from being a wonderful recreational and exercise activity, in-line and multi-line skating is frequently used by athletes as a cross-training activity for ice skating (i.e., figure skating, speed skating, short track skating, hockey, etc.) as well as for cross-country skiing. Many of the leg, and arm, motions in both ice skating and in-line and multi-line skating are similar. Thus, in-line and multi-line roller skating offers a wonderful dry land training activity for many athletes in the aforementioned sports, as well as others. Because of the cross training benefit of in-line and multi-line skating, ice skaters can improve their ice skating skills by using in-line or multi-line skates. Similarly, proficient roller skaters can more easily learn and improve their ice skating skills.

In-line and multi-line skating has some advantages over ice skating, such as the ability to skate in many more locations (i.e., roadways, parking lots, bike paths, gymnasiums, hard surfaces, etc.). With ice skating however one, obviously, is limited to only being able to skate where there is ice. Another advantage of in-line and multi-line skating, especially for the beginner, is that balancing is easier on the in-line and multi-line skate than with an ice skate.

Unfortunately, in-line and multi-line skates have some disadvantages when compared with ice skates, as well. With in-line and multi-line skates, it is much more difficult to learn how to stop effectively, if at all, on the pavement.

Further, to effectively complete a "hockey stop", where one quickly places one, or both, skates transverse to the path of travel in order to stop quickly, it is close to impossible on a roller skate without falling. Currently, in order to change directions or stop, roller skaters employ a skating loop, use a heel-mounted rubber bumper, or transversely drag the trailing skate, in lieu of a hockey stop. None of these techniques allow for as quick a stop and change of direction as a hockey stop.

Additionally, one cannot complete as small a radius turn on roller skates as one can with ice skates.

Additionally, some roller skates are employing a wheel with a hybrid composition; that is multiple materials (i.e., composite) within the cross-section of the tread area. These hybrid composition wheels have very high manufacturing and replacement costs.

Additionally, the current designs of roller skates and their wheels do not simulate the ideal leg motions made during skating and stopping. Thus, while cross-training between ice skating and roller skating is feasible because the two activities are not dissimilar, there is room for improvement in increasing the similarity between the two activities thereby enhancing cross training efforts.

Accordingly, there is a need for an improved roller skate and wheel which makes improvements over both the above mentioned and other disadvantages of the in-line and multi-line skate.

SUMMARY of INVENTION

The present invention provides a wheel for use with a roller skate, an apparatus for use with a roller skate, an improved roller skate, and a method of improving performance o-f a roller skate.

A first general aspect of the invention provides a wheel for use with a roller skate comprising:

a roller skate wheel with an asymmetrical cross-section.

A second general aspect of the invention provides an apparatus for use with a roller skate comprising:

a plurality of lines of wheels, wherein at least two lines of wheels have different coefficients of friction.

A third general aspect of the invention provides a roller skate comprising:

a plurality of lines of wheels wherein at least one wheel is asymmetrical in cross-section.

A fourth general aspect of the invention provides a roller skate comprising:

a center line of wheels, having a first coefficient of friction;

a first outer line of wheels, having a second coefficient of friction, wherein said second coefficient of friction is higher than said first coefficient of friction; and a second outer line of wheels, having a third coefficient of friction, wherein said third coefficient of friction is higher than said first coefficient of friction.

A fifth general aspect of the invention provides a roller skate comprising:

a center line of wheels having a first diameter;

at least one outer line of wheels having a second diameter, wherein the second diameter is unequal to the first diameter.

A sixth general aspect of the invention provides a roller skate comprising:

a plurality of roller skate wheels wherein at least two wheels have different coefficients of friction.

A seventh general aspect of the invention provides a roller skate comprising:

a first line of wheels, having a first coefficient of friction;

a second line of wheels, having a second coefficient of friction, wherein said first coefficient of friction is not equal to said second coefficient of friction; and, at least one of said first and second line of wheels are asymmetrical in cross-section.

An eighth general aspect of the invention provides a roller skate comprising:

a center line of wheels;

a first outer line of wheels;

a second outer line of wheels, wherein the coefficients of friction of said first and second outer lines of wheels is higher than the coefficient of friction of said center line, further wherein the wheels of said first and second outer lines of wheels are asymmetrical in cross-section.

A ninth general aspect of the invention provides a method of improving performance of a roller skate comprising:

providing a foot attachment device;

attaching to the foot attachment device a first line of wheels, having a first coefficient of friction; and attaching to the foot attachment device a second line of wheels, having a second coefficient of friction wherein said second coefficient of friction is unequal to said first coefficient of friction.

The foregoing and other features of the invention will be apparent from the following more particular description of various embodiments of the invention.

BRIEF DESCRIPTION of DRAWINGS

Some of the embodiments of this invention will be described in detail, with reference to the following figures, wherein like designations denote like members, wherein.

DETAILED DESCRIPTION OF THE INVENTION

Figure 1:
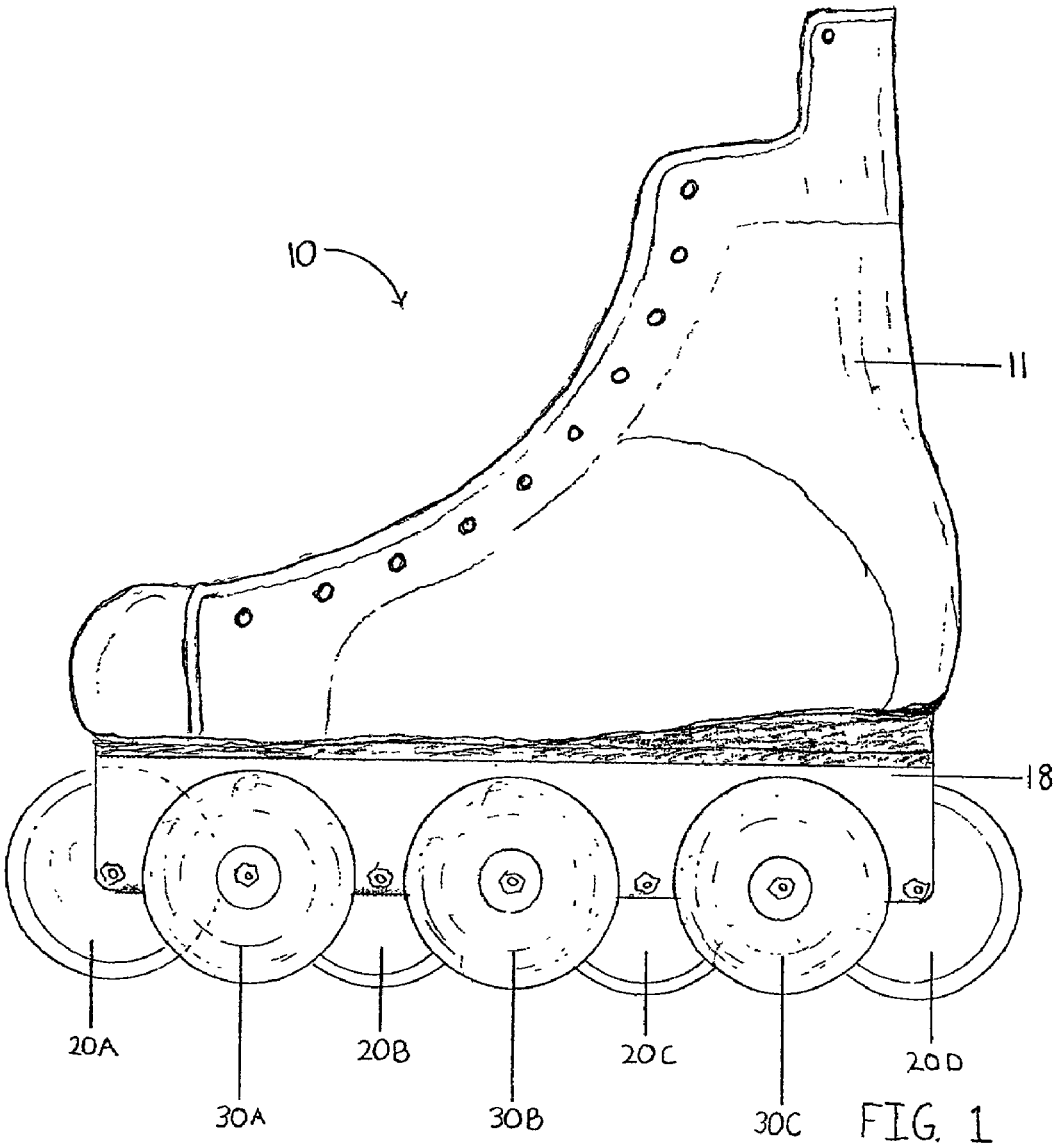
FIG. 1 depicts a side view of an improved hockey stop multi-line roller skate, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

There are essentially two separate and distinct motions made in skating. There is a gliding motion and a pushing motion. The pushing motion is when one pushes, or propels, themselves during skating. The pushing motion is made by pushing the leg and skate both sideways and behind the body (e.g., diagonally back away from the body). In ice skating, for example, the skater predominantly uses the friction of the inside edge of the pushing skate against the ice to create purchase with the ice. At the interface of the purchasing (i.e., inside) edge of the skate and the ice is where energy is translated from the leg to the ice. This is how a skater propels themself and accelerates on the ice. In general, the greater the friction and purchase between the skate blade and the ice the greater the force can be translated from the leg to the ice. This results in more efficient skating and greater speed.

The second motion made during skating is the gliding motion. This is made when the skate is pointing straight ahead in the same direction as the motion of travel. Typically, with one exception being during startups, one skate is doing the gliding motion while the other is doing the pushing motion. Also, during coasting, both skates are using the gliding motion. Sometimes during fast startups, the skater will employ the pushing motion on both skates until the desired speed is attained.

Finding the correct amount of friction between the skate and skating surface, is needed in order to stop as well. When an ice skater turns a skate transverse to the skating direction in order to stop and the skate is straight up (i.e., not angulated) the skate blade is very "slippery" (i.e., low coefficient of friction) and as a result less apt to stop the skate and skater. In this position, the skate blade would tend to slide more along the ice surface. However, when the ice skater turns the skate transverse to the skating direction and angulates (e.g., bends the blade off center) the skate, the skater is able to stop more quickly. When the skate is angulated the coefficient of friction increases. Thus, the ice skater, through practice, is able to find the appropriate amount of angulation of the skate(s) that, in turn, provides the optimal coefficient of friction and hence, stopping power to the skates. For example, for the ice skater to successfully complete a hockey stop, the skater needs to turn the skate, or skates, transverse to the direction of travel and essentially find, by angulating the skate, the ideal amount of friction between the skate and surface to slow the skate down to a full stop is the desired distance. If the ice skater obtains too much friction (i.e., "grab") the skate will grab the skating surface and stop suddenly resulting in the skater most likely falling over. This can be seen in the shortcoming of current roller skates where the wheels, in general, have too high a coefficient of friction, and thus grab the pavement too readily. The result is that it is nearly impossible to complete standard ice skating stops, such as a hockey stop, with roller skates.

As with the pushing motion, greater friction is needed during turning, as well. Friction between the surface and the skate when the skate is angulated allows the skater to turn without slipping or having the skates slide out from underneath the skater. Thus, the skater is increasing friction by angulating the skate. Greater friction will also aid in completing a tighter radius turn. Additionally, whether with an ice skate, or roller skate, the shorter the ice blade, or wheel base, the tighter the turning radius the skate is capable of making.

Thus, the present invention through its design improves roller skating by more accurately matching the skating motions and by reflecting the frictional requirements of stopping and turning. This is done via both the unique wheel design and by the unique placement and configuration of the plurality of wheels on the roller skate. Various embodiments of the present invention include, inter alia, varying the coefficients of friction of various wheels based on their use; varying the diameters of wheels based on their use; varying the layout of the lines of wheels; and, including asymmetrical wheels in some locations.

Specifically, this invention utilizes two different wheel types for a roller skate to more accurately match the two different skating motions. A first type of wheel, called the glide slide wheel, is shaped and made of a lower coefficient of friction material. The glide slide wheel is used more during the gliding motion and assists in reducing friction (i.e., "slide") during the stopping motion. The second type of wheel, called the push, turn & stop wheel, is typically made of a higher coefficient of friction material than the glide slide wheel. The push, turn & stop wheel is used more during pushing, turning and stopping.

This invention also uses a unique asymmetric shape for the push, turn & stop wheel, thereby allowing the skater to be able to alter the magnitude of friction applied to the skating surface more easily. The asymmetric portion of the push, turn & stop wheel is in the area of the tread area or contact surface. The asymmetric shape allows the skater to, via angulating the skate to varying degrees, have different amounts of the wheel tread contact the pavement. Another advantage of having a wheel with an asymmetric cross section is that they wear better than a symmetric wheel. Symmetric wheels will eventually wear in a pattern similar to an asymmetric wheel, depending on the skating and stopping patterns of the skater. Therefore, the skate can use symmetric wheels throughout, but it is not as efficient as having some asymmetric wheels on the skate.

By having a combination of heights of wheels with varying coefficients of friction, the skater can apply numerous amounts of friction to the pavement quite readily merely by angulating the skate in different amounts. By allowing for this changing of the magnitude of friction applied to the pavement depending on whether the skater is turning, stopping, gliding, or pushing results in an improved roller skate.

FIG. 1 depicts a side view of an improved hockey stop multi-line roller skate, in accordance with the present invention. The improved hockey stop multi-line roller skate, listed as 10, includes a boot 11 to which is attached a plurality of rails 18. Further attached to the plurality of rails 18 are a plurality of glide slide wheels 20 (e.g., 20A, 20B, 20C, 20D) and a plurality of push, turn & stop wheels 30 (e.g., 30A, 30B, 30C). The plurality of glide slide wheels 20 are arranged in a line 15. The plurality of push, turn & stop wheels 30, similarly, are arranged in a plurality of lines 15 beneath the boot 11.

The numerous FIGS. 2 all show the same bottom view of numerous embodiments of the present invention. The improved hockey stop multi-line roller skate 10 has a plurality of rails 18, or similar attachment devices, on the bottom of the boot 11. Through the plurality of rails 18 are a plurality of axles 16 for holding the plurality of glide slide wheels 20 and the plurality of push, turn & stop wheels 30 to the rails 18. As indicated, there are a plurality of lines 15 (e.g., 15A, 15B, 15C), or banks, of wheels beneath the boot 11. A line 15, or bank, of wheels being at least two wheels which are disposed substantially one behind the other. The skate 10 will have a center line 15B of wheels and a plurality of outer, or non-center, lines 15A, 15C of wheels. The center line 15B is substantially under, or near, the center or middle of the boot 11. An exception to this could be with a speed skater's skate 10, wherein the center line 15B is not on center on the boot 11, but significantly off-center and placed towards the turn direction of the skating. With speed skating the skating is typically done in a counter-clockwise direction (i.e., turning left), and thus, the center line 15B of a speed skating skate 10 would be towards the left on both skates 10. The outer lines 15A, 15C are either towards the inward side of the skate 10 from the center line 15B or towards the outward side of the skate 10 from the center line 15B. The inward side of the skate 10 is the side facing the other skate 10, that is the left side of the right skate 10 and the right side of the left skate 10. The outward side of the skate 10 is the side facing away from the other skate 10, that is the right side of the right skate 10 and the left side of the left skate 10. The center line 15B is made up of a plurality of glide slide wheels 20 (e.g., 20A, 20B, 20C, 20D). The various outer lines 15A, 15C are made up of a plurality of push, turn & stop wheels 30 (e.g., 30A, 30B, 30C, 30D). In some configurations of the skate, the outer lines 15A, 15C of push, turn & stop wheels 30 will have a smaller quantity of wheels 30 than the center line 15B of wheels 20. This provides a shorter wheel base on the outside lines 15A, 15C for turning resulting in allowing for tighter radius turns.

Figure 2A:
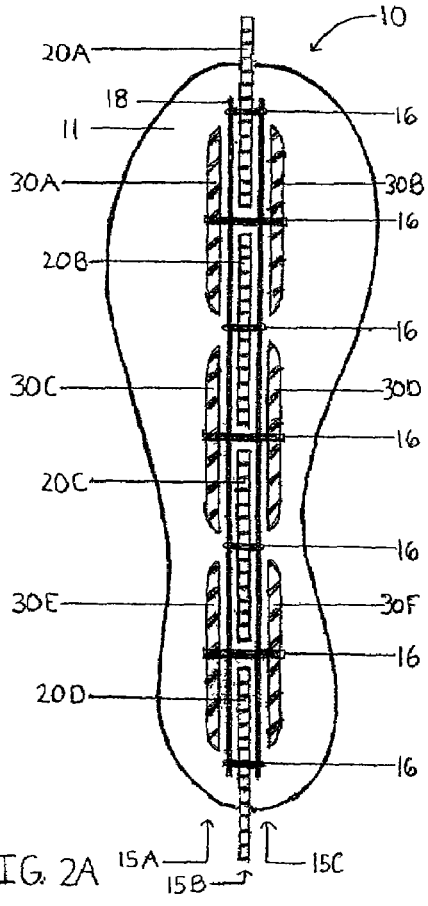
FIG. 2A depicts a bottom view of an improved hockey stop multi-line roller skate, in accordance with the present invention.

As FIG. 2A depicts, one configuration of the skate 10 has four glide slide wheels 20A, 20B, 20C, 20D in the center bank 15B and three push, turn & stop wheels 30A, 30C, 30E in one outer bank 15A and three push, turn & stop wheels 30B, 30D, 30F in the other outer bank 15C. The wheels in this configuration are attached via axles 16 to two rails 18.

Figure 2B:
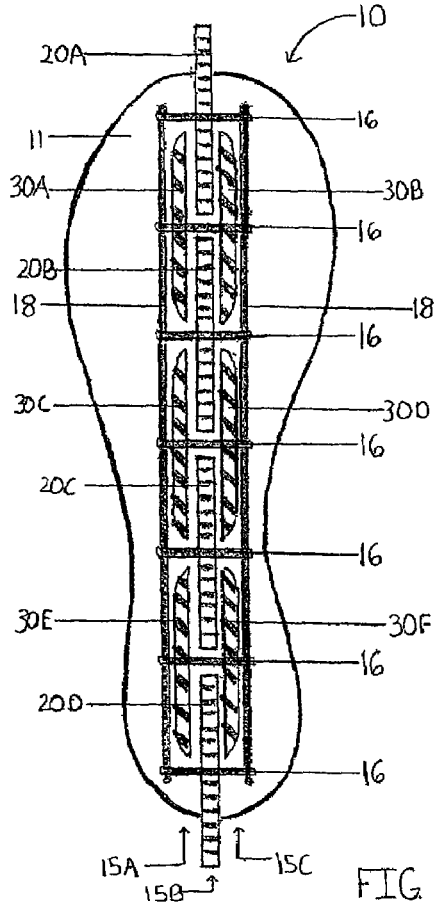
FIG. 2B depicts a bottom view of an alternative embodiment of an improved hockey stop multi-line roller skate, in accordance with the present invention.

FIG. 2B depicts another configuration of the skate 10 which has four glide slide wheels 20A, 20B, 20C, 20D in the center bank 15B and two push, turn & stop wheels 30A, 30C in one outer bank 15A and two push, turn & stop wheels 30B, 30D in the other outer bank 15C. The wheels in this configuration are attached via axles 16 to four rails 18 total. Two rails 18 are sandwich the center line 15B, while two outer rails 18 are placed outboard of the outer lines 15A, 15C.

Figure 2C:
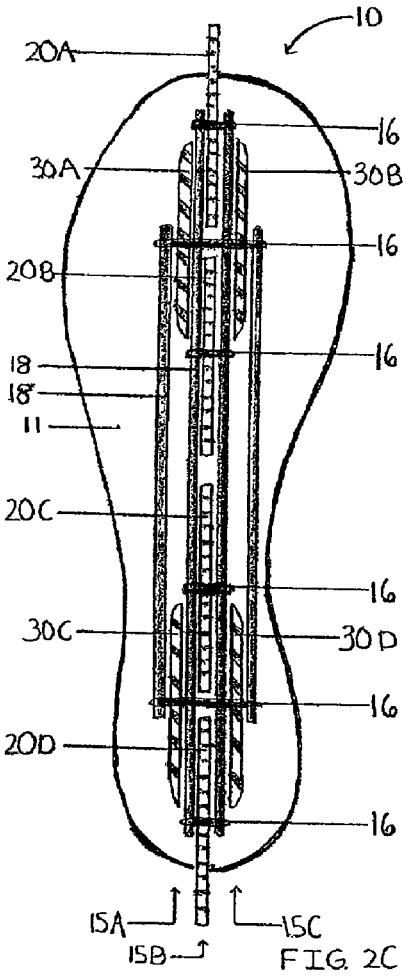
FIG. 2C depicts a bottom view of an alternative embodiment of an improved hockey stop multi-line roller skate, in accordance with the present invention.

FIG. 2C depicts another configuration of the skate 10 which has four glide slide wheels 20A, 20B, 20C, 20D in the center bank 15B and three push, turn & stop wheels 30A, 30C, 30E in one outer bank 15A and three push, turn & stop wheels 30B, 30D, 30F in the other outer bank 15C. The wheels in this configuration are attached via axles 16 to two rails 18 which are placed outboard of all the wheels.

Figure 2D:
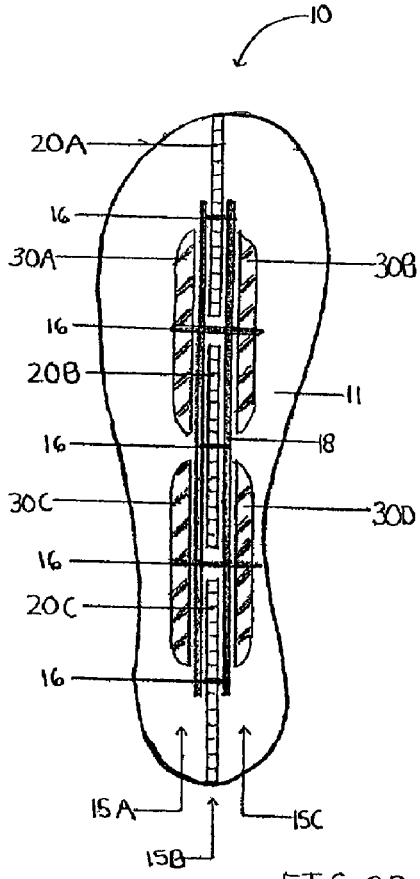
FIG. 2D depicts a bottom view of an alternative embodiment of an improved hockey stop multi-line roller skate, in accordance with the present invention.

FIG. 2D depicts another configuration of the skate 10 which has three glide slide wheels 20A, 20B, 20C in the center bank 15B and two push, turn & stop wheels 30A, 30C in one outer bank 15A and two push, turn & stop wheels 30B, 30D in the other outer bank 15C. The wheels in this configuration are attached via axles 16 to two rails 18.

Figure 2E:
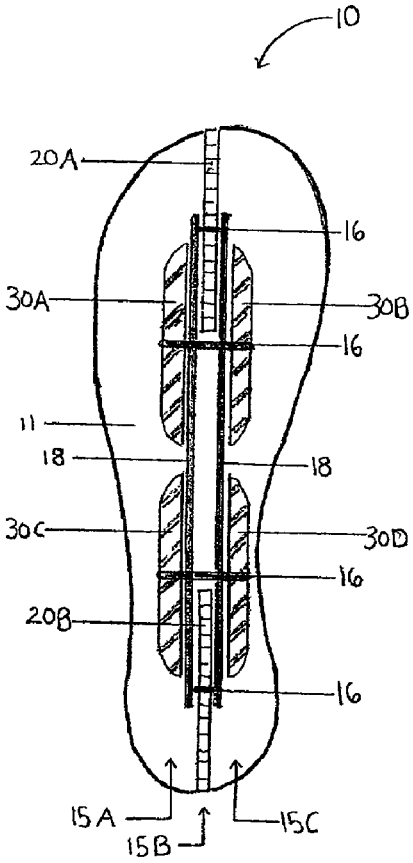
FIG. 2E depicts a bottom view of an alternative embodiment of an improved hockey stop multi-line roller skate, in accordance with the present invention.

FIG. 2E depicts another configuration of the skate 10 which has two glide slide wheels 20A, 20B in the center bank 15B and two push, turn & stop wheels 30A, 30C in one outer bank 15A and two push, turn & stop wheels 30B, 30D in the other outer bank 15C. The wheels in this configuration are attached via axles 16 to two rails 18.

Figure 2F:
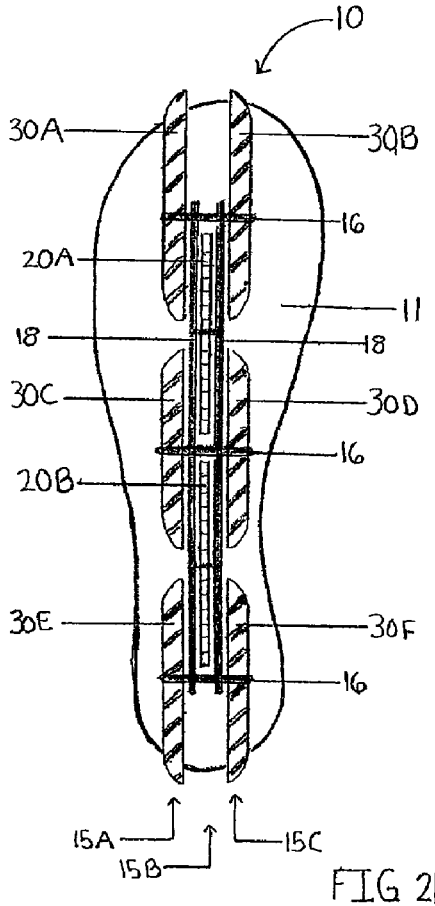
FIG. 2F depicts a bottom view of an alternative embodiment of an improved hockey stop multi-line roller skate, in accordance with the present invention.

FIG. 2F depicts another configuration of the skate 10 which has two glide slide wheels 20A, 20B in the center bank 15B and three push, turn & stop wheels 30A, 30C, 30E in one outer bank 15A and three push, turn & stop wheels 30B, 30D, 30F in the other outer bank 15C. The wheels in this configuration are attached via axles 16 to two rails 18.

Figure 2G:
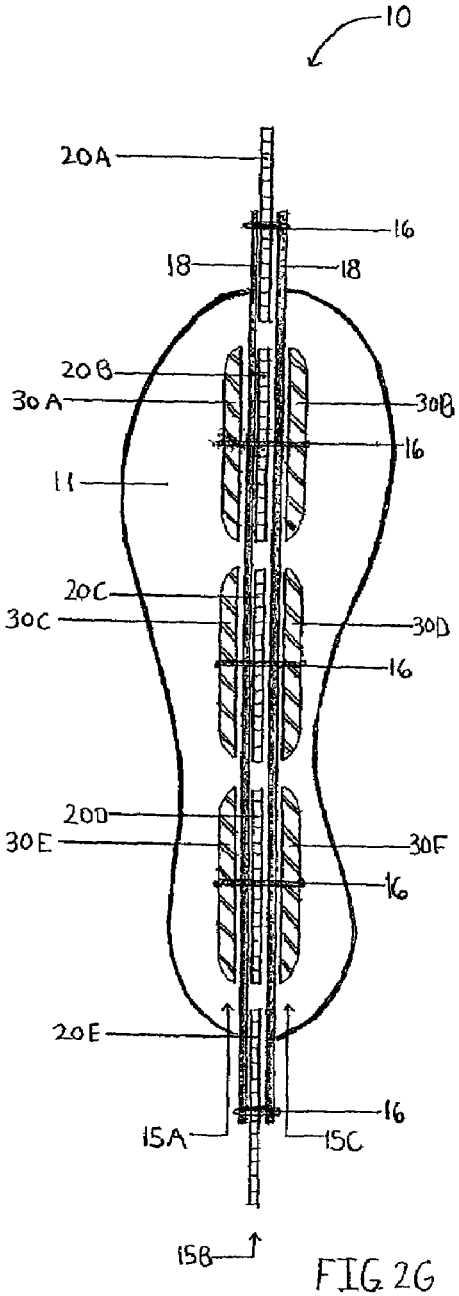
FIG. 2G depicts a bottom view of an alternative embodiment of an improved hockey stop multi-line roller skate, in accordance with the present invention.

FIG. 2G depicts another configuration of the skate 10 which has five glide slide wheels 20A, 20B, 20C, 20D, 20E in the center bank 15B and three push, turn & stop wheels 30A, 30C, 30E in one outer bank 15A and three push, turn & stop wheels 30B, 30D, 30F in the other outer bank 15C. The wheels in this configuration are attached via axles 16 to two rails 18.

Figure 2H:
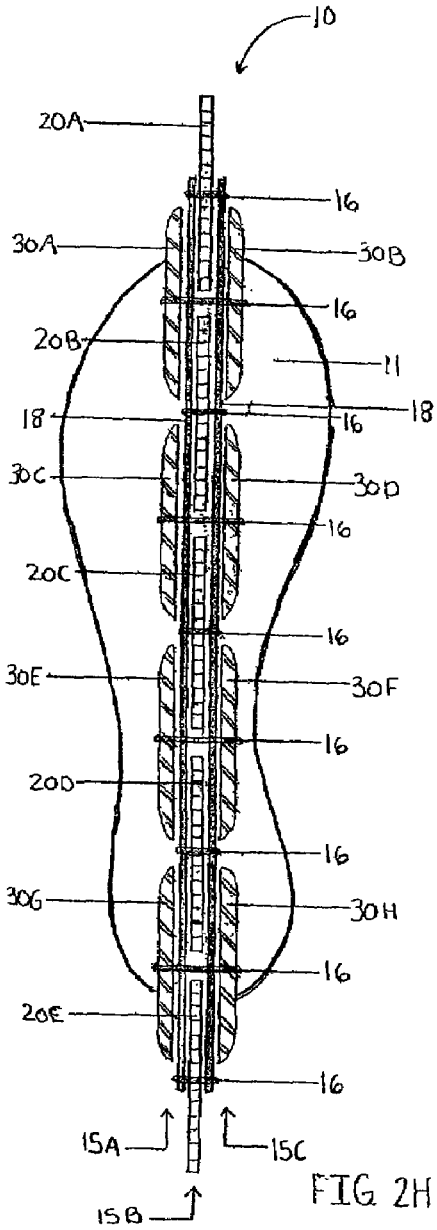
FIG. 2H depicts a bottom view of an alternative embodiment of an improved hockey stop multi-line roller skate, in accordance with the present invention.

FIG. 2H depicts another configuration of the skate 10 which has five glide slide wheels 20A, 20B, 20C, 20D, 20E in the center bank 15B and four push, turn & stop wheels 30A, 30C, 30E, 30F in one outer bank 15A and four push, turn & stop wheels 30B, 30D, 30F, 30G in the other outer bank 15C. The wheels in this configuration are attached via axles 16 to two rails 18.

Figure 2I:
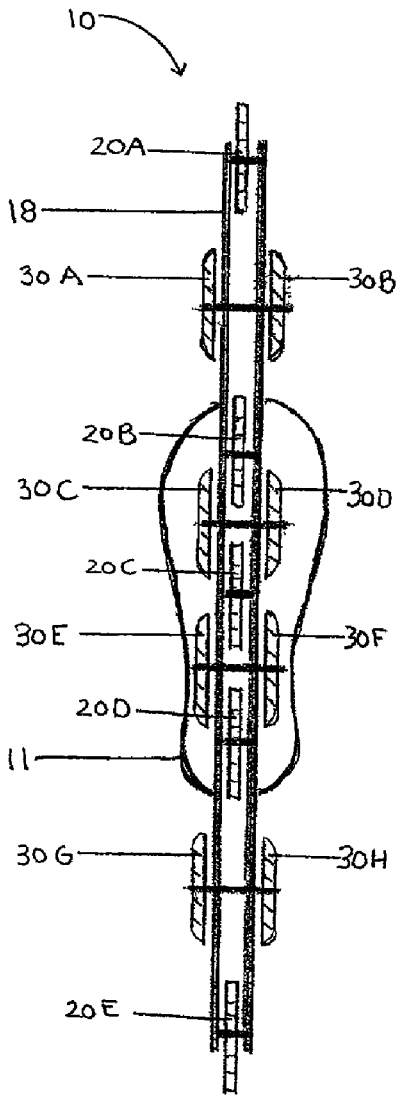
FIG. 2I depicts a bottom view of an alternative embodiment of an improved hockey stop multi-line roller skate, in accordance with the present invention.

FIG. 2I depicts another configuration of the skate 10 which has five glide slide wheels 20A, 20B, 20C, 20D, 20E in the center bank 15B and four push, turn & stop wheels 30A, 30C, 30E, 30F in one outer bank 15A and four push, turn & stop wheels 30B, 30D, 30F, 30G in the other outer bank 15C. The wheels in this configuration are attached via axles 16 to two rails 18. In this configuration both the glide slide wheels 20 and the push, turn & stop wheels 30 are not evenly spaced along the rails 18.

Figure 2J:
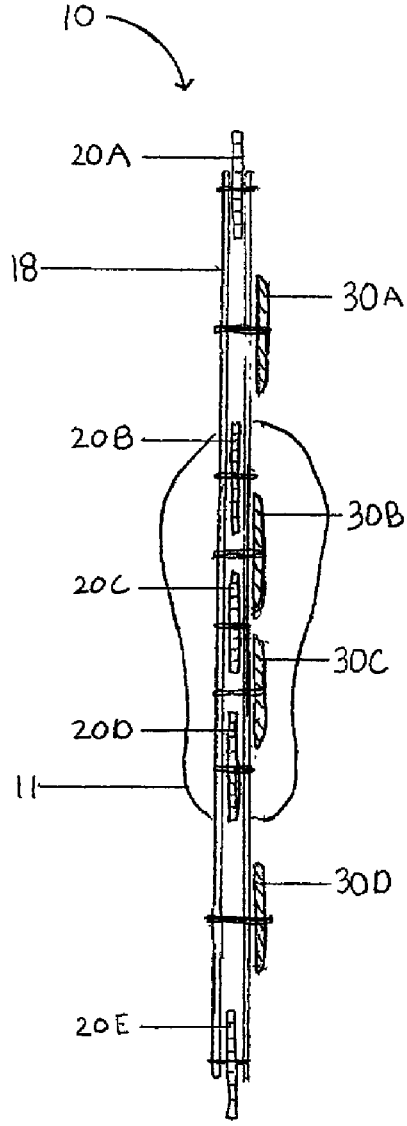
FIG. 2J depicts a bottom view of an alternative embodiment of an improved hockey stop multi-line roller skate, in accordance with the present invention.

FIG. 2J depicts another configuration of the skate 10 which has four glide slide wheels 20A, 20B, 20C, 20D in the center bank 15B and three push, turn & stop wheels 30A, 30B, 30C in one outer bank 15A. The wheels in this configuration are attached via axles 16 to three rails 18. In this configuration there is only one outer bank 15A. This skate 10 could be used, for example, for cross training for a cross-country skiing racer.

Other wheel and rail 18 configurations are possible beyond those depicted in the figures.

Figure 3:
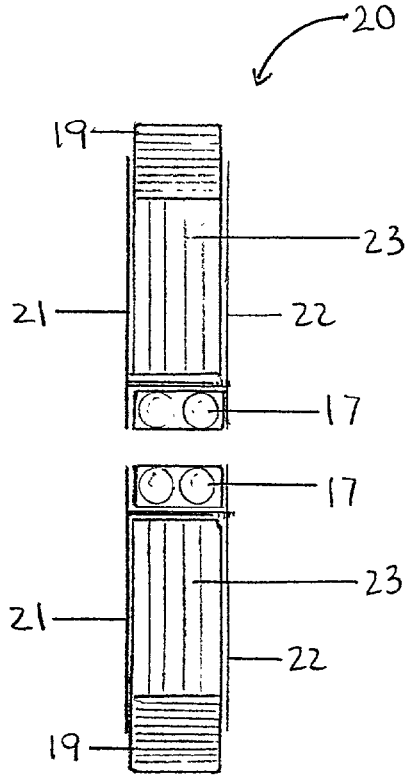
FIG. 3 depicts a cross sectional view of a glide slide wheel, in accordance with the present invention.
Figure 4:
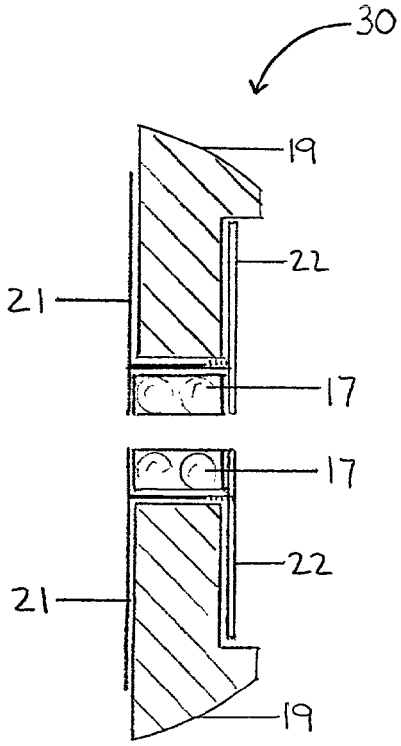
FIG. 4 depicts a cross sectional view of a push, turn & stop wheel, in accordance with the present invention.

The glide slide wheel 20 and push, turn & stop wheel 30, as depicted in FIGS. 3 and 4 respectively, are both similar and different in several respects. The glide slide wheel 20 and the push, turn & stop wheel 30 are similar in that both have a tread surface 19, replaceable bearings 17, a backing 21, and a washer nut 22. Both wheels 20, 30 may have a filler material 23 which can be the same, or different, than the trade surface 19. The user could then just replace the tread surface 19 and leave the bearing 17 and filler material 23 intact. As a result, manufacturing of a typical glide slide wheel 20 and push, turn & stop wheel 30 is cheaper than a composite wheel. Additionally, repair and replacement is typically easier and cheaper with these wheels 20, 30 in that only the tread surface 19 and/or filler material 23 need be more frequently replaced than the whole wheel construct (i.e. avoiding expensive bearing replacement). Thus, the tread surface 19 of the wheels 20, 30 are selectively removable and replaceable. The glide slide wheel 20 and the push, turn & stop wheel 30 may differ in cross sectional shape, diameter, and material.

The glide slide wheel 20 may be made of a material of lower coefficient of friction than the push, turn & stop wheel 30. For example, the glide slide wheel 20 may be made of metal, plastic, rubber, ceramic, or composite. The push, turn & stop wheel 30, for example, may be made of any of these same materials, but just of higher coefficients of friction.

The push, turn & stop wheel 30 has a cross section that may not be symmetric. The inboard edge (i.e., edge facing the center line 15B) of the push, turn & stop wheel 30 will be larger in diameter than the outboard edge (i.e., edge towards outsides of skate 10) of the push, turn & stop wheel 30. The diameter of the push, turn & stop wheel 30 decreases fairly quickly when moving from the inboard edge towards the outboard edge. This allows the skater to angulate the skate 10 and obtain varying amounts of contact between the tread surface 19 and the skate surface. Depending on the amount of angulation of the skate 10 either just the glide slide wheel 20 contacts the pavement, or a combination of the glide slide wheel 20 and push, turn & stop wheel 30 contacts the pavement, of only the push, turn & stop wheel 30 contacts the pavement. By varying the angulation appropriately the skater can find the desired, and appropriate, amount of friction for stopping.

The glide slide wheel 20, conversely, is substantially symmetrical at the tread surface 19. The shape of the tread surface 19 can be square, rounded, triangular, or other shape. The filler material 23 can be of the same material as the tread surface 19. In other embodiments, the filler material 23 of the glide slide wheel 20 may be softer than the tread material 19 so that some ride cushioning is provided.

Replacement of the tread material 19 alone of either wheel 20, 30 can be done without needing to replace the bearing 17, wheel backing 21, washer nut 22, or filler material 23. This results in an advantage of being easier and cheaper to both manufacture, rebuild, and replace the wheels 20, 30.

The diameter of the glide slide wheel 20 and the push, turn & stop wheel 30 may be the same. In an alternative embodiment the diameter of-the push, turn & stop wheel 30 at the inward, or inboard, edge may be slightly smaller the diameter of the glide slide wheel 20. In still another embodiment, the push, turn & stop wheels 30 are placed such that the glide slide wheels 20 extend slightly below the bottom edge of the push, turn & stop wheels 30. Thus, the push, turn & stop wheels 30 contact the pavement only during turning, stopping, and the pushing motion (i.e. during angulation of the skate 10). In still another embodiment, the glide slide wheels 20 are of a smaller diameter than the push, turn & stop wheels 30, but the glide slide wheels 20 are situated so that they still extend lower from the skate 10 than the larger diameter push, turn & stop wheels 30. This is done by raising the height of the axles 16 of the push, turn & stop wheels 30 so that they are higher than the axles 15 of the glide slide wheels 20. This configuration still allows for the glide slide wheels 20 to contact the pavement during gliding and sliding, where the majority of the push, turn & stop wheels 30 would only contact the pavement during skate angulation. In various embodiments, a small, narrow portion of the push, turn & stop wheels 30 may either marginally contact the skating surface, or not at all, during gliding and sliding (i.e., while skate is vertical). In other words, the bottom edge of the push, turn & stop wheels 30 can either be coplanar with the bottom edge of the glide slide wheels 20 or slightly higher.

In one embodiment, the coefficient of friction of the push, turn & stop wheels 30 is the same in both outer banks 15A, 15C. The coefficient of the push, turn & stop wheels 30 is higher than the glide slide wheels 20 in the center bank 15B. In another embodiment, although the coefficient of all the push, turn & stop wheels 30 is higher than the coefficient of the glide slide wheels 20, the coefficient of friction in the push, turn & stop wheels 30 in one outer bank 15A is different than the coefficient of friction in the push, turn & stop wheels 30 in the other outer bank 15C. For example, for short track skating, where the skater is turning in predominantly one direction, the skater might desire to have the higher coefficient of friction on the push, turn & stop wheels 30 on the bank 15 that is on the inside edge of the skate 10 in the direction of the turn.

Although a boot 11 is shown in several figures, some embodiments allow for various other attachment means of the wheels to the foot of the skater in lieu of the boot 11. For example, there can be no boot 11 where the skate 10 could be attached to a foot via buckles or VELCRO straps.

Similarly, other embodiments of the rail 18 are possible than shown in the figures. The rails 18 may be continuous or discontinuous. The rail 18 need not be solid. The rail 18 could be perforated. The rail 18 could be of various shapes. The attachment means of the wheels to the boot 11 may be individual attachments of the axles 16 to the bottom of the boot 11 or other means.

Although the embodiment of a skate 10 is shown in several figures, several embodiments of the current invention include only portions of the skate 10. For example, replacement wheels can be available to the skater. A skater can obtain a single glide slide wheel 20 or push, turn & stop wheel 30 or sets of the same when replacements are required. Similarly, a skater could experiment with altering coefficients of friction for the push, turn & stop wheels 30 or the glide slide wheels 20 depending on the skater's physiology, skating technique, uses, pavement, etc. Additionally, a skater could purchase an entire line 15 of wheels, or all three lines 15 of wheels, already attached to the rails 18 for subsequent attachment to a boot 11.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A roller skate roller apparatus, comprising:

a center wheel bank comprising a plurality of glide slide wheels residing coplanar to one another in a common center wheel bank plane;

a first outer wheel bank comprising a first plurality of push, turn and stop wheels residing coplanar to one another in a common first outer wheel bank plane on a first side of said center wheel bank;

said first plurality of push, turn and stop wheels rotating independently of said glide slide wheels;

said first outer wheel bank plane aligned parallel to said center wheel bank plane;

a second outer wheel bank comprising a second plurality of push, turn and stop wheels residing coplanar to one another in a common second outer wheel bank plane on a second side of said center wheel bank opposite said first side;

said second plurality of push, turn and stop wheels rotating independently of said glide slide wheels and said first plurality of push, turn and stop wheels;

said second outer wheel bank aligned parallel to said center wheel bank plane and parallel to said first outer wheel bank plane;

said first plurality of push, turn and stop wheels comprising first bank asymmetric cross sections comprising first bank inboard edges thereof larger in diameter than first bank outboard edges thereof;

said second plurality of push, turn and stop wheels comprising second bank asymmetric cross sections comprising second bank inboard edges thereof larger in diameter than second bank outboard edges thereof;

each of said glide slide wheels and said push, turn and stop wheels comprising a width thereof which is substantially smaller than a diameter thereof; and said center wheel bank, first outer wheel bank, and second outer wheel bank comprising a total combined width thereof which is substantially smaller than a width of a human foot which said roller skate roller apparatus is intended to support; wherein:

there is no non-rotating slip surface between said glide slide wheels and said first plurality of push, turn and stop wheels for contacting an intended skating surface;

there is no non-rotating slip surface between said glide slide wheels and said second plurality of push, turn and stop wheels for contacting the intended skating surface; and when said center wheel bank, first outer wheel bank and second outer wheel bank are turned and angulated relative to a skating direction, said coplanar, parallel wheel bank alignments in combination with said asymmetric cross sections engage the intended skating surface to simulate ice skate hockey stops and turns.

2. The roller apparatus of claim 1, further comprising:

a glide slide kinetic coefficient of friction between said glide slide wheels and the intended skating surface; and a push, turn and stop kinetic coefficient of friction between said push, turn and stop wheels and the intended skating surface; wherein:

said push, turn and stop kinetic coefficient of friction is higher than said glide slide kinetic coefficient of friction; and when said center wheel bank, first outer wheel bank and second outer wheel bank are turned and angulated relative to a skating direction, said coplanar, parallel wheel bank alignments in combination with said asymmetric cross sections and in further combination with said higher kinetic coefficient of friction engage the intended skating surface to further simulate ice skate hockey stops and turns.

3. The roller apparatus of claim 2, further comprising:

bottom edges of said glide slide wheels extending below bottom edges of said push, turn and stop wheels; wherein:

when said center wheel bank, first outer wheel bank and second outer wheel bank are turned and angulated relative to a skating direction, said coplanar, parallel wheel bank alignments in combination with said asymmetric cross sections and in further combination with said higher kinetic coefficient of friction in yet further combination with said extended bottom edges of said lower glide slide wheels engage the intended skating surface to further simulate ice skate hockey stops and turns.

4. The roller apparatus of claim 3:

said glide slide wheels comprising a diameter larger than a diameter of said push, turn and stop wheels, thereby extending said bottom edges of said glide slide wheels below said bottom edges of said push, turn and stop wheels.

5. The roller apparatus of claim 3:

said glide slide wheels comprising glide slide axles thereof situated lower than push, turn and stop axles of said push, turn and stop wheels, thereby extending said bottom edges of said glide slide wheels below said bottom edges of said push, turn and stop wheels.

6. The roller apparatus of claim 3 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

7. The roller apparatus of claim 2 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

8. The roller apparatus of claim 1, further comprising:

bottom edges of said glide slide wheels extending below bottom edges of said push, turn and stop wheels; wherein:

when said center wheel bank, first outer wheel bank and second outer wheel bank are turned and angulated relative to a skating direction, said coplanar, parallel wheel bank alignments in combination with said asymmetric cross sections and in further combination with said extended bottom edges of said lower glide slide wheels engage the intended skating surface to further simulate ice skate hockey stops and turns.

9. The roller apparatus of claim 8:

said glide slide wheels comprising a diameter larger than a diameter of said push, turn and stop wheels, thereby extending said bottom edges of said glide slide wheels below said bottom edges of said push, turn and stop wheels.

10. The roller apparatus of claim 8:

said glide slide wheels comprising glide slide axles thereof situated lower than push, turn and stop axles of said push, turn and stop wheels, thereby extending said bottom edges of said glide slide wheels below said bottom edges of said push, turn and stop wheels.

11. The roller apparatus of claim 8 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

12. The roller apparatus of claim 1 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

13. The apparatus of claim 1, further comprising:

bottoms of said plurality of glide slide wheels residing collinearly in a non-curved line running from a front to a rear of said apparatus;

bottoms of said first plurality of push, turn and stop wheels residing collinearly in a non-curved line running from a front to a rear of said apparatus; and bottoms of said second plurality of push, turn and stop wheels residing collinearly in a non-curved line running from a front to a rear of said apparatus.

14. A roller skate roller apparatus, comprising:

a center wheel bank comprising a plurality of glide slide wheels residing coplanar to one another in a common center wheel bank plane;

a first outer wheel bank comprising a first plurality of push, turn and stop wheels residing coplanar to one another in a common first outer wheel bank plane on a first side of said center wheel bank;

said first outer wheel bank plane aligned parallel to said center wheel bank plane;

said first plurality of push, turn and stop wheels rotating independently of said glide slide wheels;

a second outer wheel bank comprising a second plurality of push, turn and stop wheels residing coplanar to one another in a common second outer wheel bank plane on a second side of said center wheel bank opposite said first side;

said second plurality of push, turn and stop wheels rotating independently of said glide slide wheels and said first plurality of push, turn and stop wheels;

said second outer wheel bank aligned parallel to said center wheel bank plane and parallel to said first outer wheel bank plane;

a glide slide kinetic coefficient of friction between said glide slide wheels and an intended skating surface;

a push, turn and stop kinetic coefficient of friction between said push, turn and stop wheels and an intended skating surface;

each of said glide slide wheels and said push, turn and stop wheels comprising a width thereof which is substantially smaller than a diameter thereof; and said center wheel bank, first outer wheel bank, and second outer wheel bank comprising a total combined width thereof which is substantially smaller than a width of a human foot which said roller skate roller apparatus is intended to support; wherein:

said push, turn and stop kinetic coefficient of friction is higher than said glide slide kinetic coefficient of friction;

there is no non-rotating slip surface between said glide slide wheels and said first plurality of push, turn and stop wheels for contacting the intended skating surface;

there is no non-rotating slip surface between said glide slide wheels and said second plurality of push, turn and stop wheels for contacting the intended skating surface; and when said center wheel bank, first outer wheel bank and second outer wheel bank are turned and angulated relative to a skating direction, said coplanar, parallel wheel bank alignments in combination with said higher kinetic coefficient of friction engage the intended skating surface to simulate ice skate hockey stops and turns.

15. The roller apparatus of claim 14, further comprising:

bottom edges of said glide slide wheels extending below bottom edges of said push, turn and stop wheels; wherein:

when said center wheel bank, first outer wheel bank and second outer wheel bank are turned and angulated relative to a skating direction, said coplanar, parallel wheel bank alignments in combination with said higher kinetic coefficient of friction in further combination with said extended bottom edges of said lower glide slide wheels engage the intended skating surface to further simulate ice skate hockey stops and turns.

16. The roller apparatus of claim 15:

said glide slide wheels comprising a diameter larger than a diameter of said push, turn and stop wheels, thereby extending said bottom edges of said glide slide wheels below said bottom edges of said push, turn and stop wheels.

17. The roller apparatus of claim 15:

said glide slide wheels comprising glide slide axles thereof situated lower than push, turn and stop axles of said push, turn and stop wheels, thereby extending said bottom edges of said glide slide wheels below said bottom edges of said push, turn and stop wheels.

18. The roller apparatus of claim 15 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

19. The roller apparatus of claim 14 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

20. The apparatus of claim 14, further comprising:

bottoms of said plurality of glide slide wheels residing collinearly in a non curved line running from a front to a rear of said apparatus;

bottoms of said first plurality of push, turn and stop wheels residing collinearly in a non curved line running from a front to a rear of said apparatus; and bottoms of said second plurality of push, turn and stop wheels residing collinearly in a non curved line running from a front to a rear of said apparatus.

21. A roller skate roller apparatus, comprising:

a center wheel bank comprising a plurality of glide slide wheels residing coplanar to one another in a common center wheel bank plane;

a first outer wheel bank comprising a first plurality of push, turn and stop wheels residing coplanar to one another in a common first outer wheel bank plane on a first side of said center wheel bank;

said first plurality of push, turn and stop wheels rotating independently of said glide slide wheels;

said first outer wheel bank plane aligned parallel to said center wheel bank plane;

a second outer wheel bank comprising a second plurality of push, turn and stop wheels residing coplanar to one another in a common second outer wheel bank plane on a second side of said center wheel bank opposite said first side;

said second plurality of push, turn and stop wheels rotating independently of said glide slide wheels and said first plurality of push, turn and stop wheels;

said second outer wheel bank aligned parallel to said center wheel bank plane and parallel to said first outer wheel bank plane;

bottom edges of said glide slide wheels extending below bottom edges of said push, turn and stop wheels;

each of said glide slide wheels and said push, turn and stop wheels comprising a width thereof which is substantially smaller than a diameter thereof; and said center wheel bank, first outer wheel bank, and second outer wheel bank comprising a total combined width thereof which is substantially smaller than a width of a human foot which said roller skate roller apparatus is intended to support; wherein:

there is no non-rotating slip surface between said glide slide wheels and said first plurality of push, turn and stop wheels for contacting an intended skating surface;

there is no non-rotating slip surface between said glide slide wheels and said second plurality of push, turn and stop wheels for contacting the intended skating surface; and when said center wheel bank, first outer wheel bank and second outer wheel bank are turned and angulated relative to a skating direction, said coplanar, parallel wheel bank alignments in combination with said extended bottom edges of said lower glide slide wheels engage the intended skating surface to simulate ice skate hockey stops and turns.

22. The roller apparatus of claim 21:

said glide slide wheels comprising a diameter larger than a diameter of said push, turn and stop wheels, thereby extending said bottom edges of said glide slide wheels below said bottom edges of said push, turn and stop wheels.

23. The roller apparatus of claim 21:

said glide slide wheels comprising glide slide axles thereof situated lower than push, turn and stop axles of said push, turn and stop wheels, thereby extending said bottom edges of said glide slide wheels below said bottom edges of said push, turn and stop wheels.

24. The roller apparatus of claim 21 in combination with a roller skate boot, together forming a roller skate, further comprising:

said roller skate boot;

attachment devices attaching and aligning said center wheel bank and said outer wheel banks substantially perpendicularly downwardly from a bottom plane of said roller skate boot and substantially from a front to a rear of said roller skate boot.

25. The apparatus of claim 21, further comprising:

bottoms of said plurality of glide slide wheels residing collinearly in a non-curved line running from a front to a rear of said apparatus;

bottoms of said first plurality of push, turn and stop wheels residing collinearly in a non-curved line running from a front to a rear of said apparatus; and bottoms of said second plurality of push, turn and stop wheels residing collinearly in a non-curved line running from a front to a rear of said apparatus.

26. A method for using roller skates for simulating hockey stops and turns, wherein:

a center wheel bank of a roller skate comprises a plurality of glide slide wheels residing coplanar to one another in a common center wheel bank plane;

a first outer wheel bank of the roller skate comprises a first plurality of push, turn and stop wheels residing coplanar to one another in a common first outer wheel bank plane on a first side of said center wheel bank;

said first plurality of push, turn and stop wheels rotating independently of said glide slide wheels;

said first outer wheel bank plane is aligned parallel to said center wheel bank plane;

a second outer wheel bank of the roller skate comprises a second plurality of push, turn and stop wheels residing coplanar to one another in a common second outer wheel bank plane on a second side of said center wheel bank opposite said first side;

said second plurality of push, turn and stop wheels rotating independently of said glide slide wheels and said first plurality of push, turn and stop wheels;

said second outer wheel bank is aligned parallel to said center wheel bank plane and parallel to said first outer wheel bank plane;

said first plurality of push, turn and stop wheels comprise first bank asymmetric cross sections comprising first bank inboard edges thereof larger in diameter than first bank outboard edges thereof;

said second plurality of push, turn and stop wheels comprises second bank asymmetric cross sections comprising second bank inboard edges thereof larger in diameter than second bank outboard edges thereof;

each of said glide slide wheels and said push, turn and stop wheels comprise a width thereof which is substantially smaller than a diameter thereof; and said center wheel bank, first outer wheel bank, and second outer wheel bank comprise a total combined width thereof which is substantially smaller than a width of a human foot which said roller skate is intended to support; said method comprising the steps of:

engaging a skating surface with said coplanar, parallel wheel bank alignments in combination with said asymmetric cross sections;

not engaging the skating surface with any non-rotating slip surface between said glide slide wheels and said first plurality of push, turn and stop wheels;

not engaging the skating surface with any non-rotating slip surface between said glide slide wheels and said second plurality of push, turn and stop wheels; and turning and angulating said center wheel bank, said first outer wheel bank, and said second outer wheel bank relative to a skating direction by employing body motions simulating ice skate hockey stops and turns.

27. The method of claim 26, wherein:

said glide slide wheels and the skating surface comprise a glide slide kinetic coefficient of friction therebetween;

said push, turn and stop wheels and the skating surface comprise a push, turn and stop kinetic coefficient of friction therebetween; and said push, turn and stop kinetic coefficient of friction is higher than said glide slide kinetic coefficient of friction;

said method further comprising the step of:

engaging the skating surface with said coplanar, parallel wheel bank alignments and said asymmetric cross sections in further combination with said higher kinetic coefficient of friction.

28. The method of claim 27, wherein:

bottom edges of said glide slide wheels extend below bottom edges of said push, turn and stop wheels; said method further comprising the step of:

engaging said skating surface with said coplanar, parallel wheel bank alignments, said asymmetric cross sections, and said higher kinetic coefficient of friction in further combination with said extended bottom edges of said lower glide slide wheels.

29. The method of claim 27, further comprising the step of:

extending said bottom edges of said glide slide wheels below said bottom edges of said push, turn and stop wheels using said glide slide wheels comprising a diameter larger than a diameter of said push, turn and stop wheels.

30. The method of claim 27, further comprising the step of:

extending said bottom edges of said glide slide wheels below said bottom edges of said push, turn and stop wheels using said glide slide wheels comprising glide slide axles thereof situated lower than push, turn and stop axles of said push, turn and stop wheels.

31. The method of claim 26, wherein:

bottom edges of said glide slide wheels extend below bottom edges of said push, turn and stop wheels; said method further comprising the step of:

engaging said skating surface with said coplanar, parallel wheel bank alignments and said asymmetric cross sections and in further combination with said extended bottom edges of said lower glide slide wheels.

32. The method of claim 31, further comprising the step of:

extending said bottom edges of said glide slide wheels below said bottom edges of said push, turn and stop wheels using said glide slide wheels comprising a diameter larger than a diameter of said push, turn and stop wheels.

33. The method of claim 31, further comprising the step of:

extending said bottom edges of said glide slide wheels below said bottom edges of said push, turn and stop wheels using said glide slide wheels comprising glide slide axles thereof situated lower than push, turn and stop axles of said push, turn and stop wheels.

34. The method of claim 26, wherein:

bottoms of said plurality of glide slide wheels further reside collinearly in a non-curved line running from a front to a rear of said apparatus;

bottoms of said first plurality of push, turn and stop wheels further reside collinearly in a non-curved line running from a front to a rear of said apparatus; and bottoms of said second plurality of push, turn and stop wheels further reside collinearly in a non-curved line running from a front to a rear of said apparatus.

35. A method for using roller skates for simulating ice skate hockey stops and turns, wherein:

a center wheel bank of a roller skate comprises a plurality of glide slide wheels residing coplanar to one another in a common center wheel bank plane;

a first outer wheel bank of the roller skate comprises a first plurality of push, turn and stop wheels residing coplanar to one another in a common first outer wheel bank plane on a first side of said center wheel bank;

said first plurality of push, turn and stop wheels rotating independently of said glide slide wheels;

said first outer wheel bank plane is aligned parallel to said center wheel bank plane;

a second outer wheel bank of the roller skate comprises a second plurality of push, turn and stop wheels residing coplanar to one another in a common second outer wheel bank plane on a second side of said center wheel bank opposite said first side;

said second plurality of push, turn and stop wheels rotating independently of said glide slide wheels and said first plurality of push, turn and stop wheels;

said second outer wheel bank is aligned parallel to said center wheel bank plane and parallel to said first outer wheel bank plane;

said glide slide wheels and the skating surface comprise a glide slide kinetic coefficient of friction therebetween;

said push, turn and stop wheels and the skating surface comprise a push, turn and stop kinetic coefficient of friction therebetween;

said push, turn and stop kinetic coefficient of friction is higher than said glide slide kinetic coefficient of friction;

each of said glide slide wheels and said push, turn and stop wheels comprise a width thereof which is substantially smaller than a diameter thereof; and said center wheel bank, first outer wheel bank, and second outer wheel bank comprise a total combined width thereof which is substantially smaller than a width of a human foot which said roller skate is intended to support; said method comprising the steps of:

engaging a skating surface with said coplanar, parallel wheel bank alignments in combination with said higher kinetic coefficient of friction;

not engaging the skating surface with any non-rotating slip surface between said glide slide wheels and said first plurality of push, turn and stop wheels;

not engaging the skating surface with any non-rotating slip surface between said glide slide wheels and said second plurality of push, turn and stop wheels; and turning and angulating said center wheel bank, said first outer wheel bank, and said second outer wheel bank relative to a skating direction by employing body motions simulating ice skate hockey stops and turns.

36. The method of claim 35, wherein:

bottom edges of said glide slide wheels extend below bottom edges of said push, turn and stop wheels; said method further comprising the step of:

engaging said skating surface with said coplanar, parallel wheel bank alignments and said higher kinetic coefficient of friction in further combination with said extended bottom edges of said lower glide slide wheels.

37. The method of claim 36, further comprising the step of:

extending said bottom edges of said glide slide wheels below said bottom edges of said push, turn and stop wheels using said glide slide wheels comprising a diameter larger than a diameter of said push, turn and stop wheels.

38. The method of claim 36, further comprising the step of:

extending said bottom edges of said glide slide wheels below said bottom edges of said push, turn and stop wheels using said glide slide wheels comprising glide slide axles thereof situated lower than push, turn and stop axles of said push, turn and stop wheels.

39. The method of claim 35, wherein:

bottoms of said plurality of glide slide wheels further reside collinearly in a non-curved line running from a front to a rear of said apparatus;

bottoms of said first plurality of push, turn and stop wheels further reside collinearly in a non-curved line running from a front to a rear of said apparatus; and bottoms of said second plurality of push, turn and stop wheels further reside collinearly in a non-curved line running from a front to a rear of said apparatus.

40. A method for using roller skates for simulating ice skate hockey stops and turns, wherein:

a center wheel bank of a roller skate comprises a plurality of glide slide wheels residing coplanar to one another in a common center wheel bank plane;

a first outer wheel bank of the roller skate comprises a first plurality of push, turn and stop wheels residing coplanar to one another in a common first outer wheel bank plane on a first side of said center wheel bank;

said first plurality of push, turn and stop wheels rotating independently of said glide slide wheels;

said first outer wheel bank plane is aligned parallel to said center wheel bank plane;

a second outer wheel bank of the roller skate comprises a second plurality of push, turn and stop wheels residing coplanar to one another in a common second outer wheel bank plane on a second side of said center wheel bank opposite said first side;

said second plurality of push, turn and stop wheels rotating independently of said glide slide wheels and said first plurality of push, turn and stop wheels;

said second outer wheel bank is aligned parallel to said center wheel bank plane and parallel to said first outer wheel bank plane;

bottom edges of said glide slide wheels extend below bottom edges of said push, turn and stop wheels;

each of said glide slide wheels and said push, turn and stop wheels comprise a width thereof which is substantially smaller than a diameter thereof; and said center wheel bank, first outer wheel bank, and second outer wheel bank comprise a total combined width thereof which is substantially smaller than a width of a human foot which said roller skate is intended to support; said method further comprising the step of:

engaging a skating surface with said coplanar, parallel wheel bank alignments in combination with said extended bottom edges of said lower glide slide wheels;

not engaging the skating surface with any non rotating slip surface between said glide slide wheels and said first plurality of push, turn and stop wheels;

not engaging the skating surface with any non-rotating slip surface between said glide slide wheels and said second plurality of push, turn and stop wheels; and turning and angulating said center wheel bank, said first outer wheel bank, and said second outer wheel bank relative to a skating direction by employing body motions simulating ice skate hockey stops and turns with ice skates.

41. The method of claim 40, further comprising the step of:

extending said bottom edges of said glide slide wheels below said bottom edges of said push, turn and stop wheels using said glide slide wheels comprising a diameter larger than a diameter of said push, turn and stop wheels.

42. The method of claim 40, further comprising the step of:

extending said bottom edges of said glide slide wheels below said bottom edges of said push, turn and stop wheels using said glide slide wheels comprising glide slide axles thereof situated lower than push, turn and stop axles of said push, turn and stop wheels.

43. The method of claim 40, wherein:

bottoms of said plurality of glide slide wheels further reside collinearly in a non-curved line running from a front to a rear of said apparatus;

bottoms of said first plurality of push, turn and stop wheels further reside collinearly in a non-curved line running from a front to a rear of said apparatus; and bottoms of said second plurality of push, turn and stop wheels further reside collinearly in a non-curved line running from a front to a rear of said apparatus.

* * * * *